US008114230B1

(12) United States Patent
Basom

(10) Patent No.: US 8,114,230 B1
(45) Date of Patent: Feb. 14, 2012

(54) COMPOSITION 4 (C-4) SIMULANTS

(75) Inventor: Kenneth E. Basom, Waldorf, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 12/925,394

(22) Filed: Oct. 8, 2010

(51) Int. Cl.

| | |
|---|---|
| ***C06B 31/00*** | (2006.01) |
| ***C06B 31/28*** | (2006.01) |
| ***C06B 31/02*** | (2006.01) |
| ***C06B 25/00*** | (2006.01) |
| ***C06B 25/34*** | (2006.01) |
| ***D03D 23/00*** | (2006.01) |
| ***D03D 43/00*** | (2006.01) |

(52) U.S. Cl. ..... 149/61; 149/45; 149/46; 149/88; 149/92; 149/109.4

(58) Field of Classification Search ..... 149/45, 149/46, 61, 88, 92, 109.4
See application file for complete search history.

(56) References Cited

U.S. PATENT DOCUMENTS

| | | | | |
|---|---|---|---|---|
| 3,119,705 | A * | 1/1964 | Kintish et al. | 106/220 |
| 3,457,329 | A * | 7/1969 | Sherman et al. | 525/178 |
| 5,359,936 | A * | 11/1994 | Simpson et al. | 102/355 |
| 5,413,812 | A | 5/1995 | Simpson et al. | |
| 5,648,636 | A | 7/1997 | Simpson et al. | |
| 5,958,299 | A * | 9/1999 | Kury et al. | 252/408.1 |
| 7,744,710 | B2 | 6/2010 | Doll et al. | |
| 2006/0037509 | A1 * | 2/2006 | Kneisl | 102/355 |
| 2006/0219341 | A1 | 10/2006 | Johnston et al. | |
| 2007/0221087 | A1 * | 9/2007 | Adebimpe et al. | 102/355 |
| 2007/0281358 | A1 | 12/2007 | Cohen-Arazi et al. | |
| 2009/0151591 | A1 | 6/2009 | Ohlsson et al. | |
| 2009/0199936 | A1 * | 8/2009 | Hagit et al. | 149/33 |
| 2009/0211484 | A1 | 8/2009 | Truitt et al. | |
| 2010/0116385 | A1 | 5/2010 | Johnston et al. | |

OTHER PUBLICATIONS

"Research Highlight:Taming Explosives forTraining," pp. 24-25,Lawrence Livermore National Laboratory,Science & Technology Review Sep. 1997;https://www.llnl.gov/str/pdfs/9_97.3.

Renful Premier Technologies, www.simulants.co.uk/C4-Simulant.htm-Renful Premier Technologies, C-4 Simulants Website last visited:Sep. 13, 2010.

SecureSearch Inc.,www.securesearchinc.com/products/exlex.htm—SecureSearch Inc.Ex-L-Ex-"A" Explosive Simulant Website last visited:Sep. 13, 2010.

* cited by examiner

*Primary Examiner* — James McDonough
(74) *Attorney, Agent, or Firm* — Fredric J. Zimmerman

(57) ABSTRACT

High fidelity, non-explosive training aids (simulants) which simulate the properties of the explosive composition 4 (C-4) are described. The materials of the training aid are formulated to simulate the appearance, manifest rheological properties (pliability, plasticity), density, and "feel" of the actual C-4 as well as simulate the combustion behavior of C-4 when subjected to the informal "flame test" used to identify the material in the field. Additionally, the materials give the same signature as actual C-4 when tested by portable detection equipment such as electronic trace detectors or color forming reagents. The materials also generate the same imagery as C-4 when subjected to X-ray analysis.

19 Claims, No Drawings

COMPOSITION 4 (C-4) SIMULANTS

STATEMENT OF GOVERNMENT INTEREST

The embodiments of the invention described herein may be manufactured and used by or for the Government of the United States of America for governmental purposes without the payment of any royalties thereon or therefor.

BACKGROUND

Simulants for C-4 are currently manufactured by several private companies. The materials used in their manufacture vary greatly. For example, simulants have been composed of materials such as modeling clay, the actual C-4 binder system with the energetic supplanted by crystalline surrogates of similar density, or the actual energetic material used in C-4 (research development explosive, "RDX") dispersed over inert beads with a high surface area.

BRIEF SUMMARY

One aspect of the invention provides a composition 4 simulant including a base mixture including at least one rheological agents in an amount effective for producing rheological properties of composition 4; and at least one energetic components selected from the group consisting of ammonium nitrate, potassium nitrate, and RDX; where at least one energetic components include an amount effective for permitting simulant combustion but prohibiting simulant explosion.

Another aspect of the invention provides a composition 4 simulant including a mixture of non-energetic components including at least one of a dispersing agent, a stabilizing agent, a thickening agent, a vinyl polymer, a plasticizer, and a gelling agent; and a mixture of energetic components, including RDX, in an amount effective for permitting simulant combustion but prohibiting simulant explosion.

A further aspect of the invention provides a composition 4 simulant including ammonium nitrate, potassium nitrate, RDX, sucrose, hexamine, melamine, colloidal silica, polyisobutylene, mineral oil, dioctyladipate, dimethyldinitrobutane, and gelatin.

The foregoing is a summary and thus may contain simplifications, generalizations, and omissions of detail; consequently, those skilled in the art will appreciate that the summary is illustrative only and is not intended to be in any way limiting.

For a better understanding of the embodiments, together with other and further features and advantages thereof, reference is made to the following description. The scope of the invention will be pointed out in the appended claims.

DETAILED DESCRIPTION

It will be readily understood that the components of the embodiments, as generally described herein, may be arranged differently from the described exemplary embodiments. Thus, the following more detailed description of the exemplary embodiments is not intended to limit the scope of the claims, but is merely representative of those embodiments.

Reference throughout this specification to "embodiment(s)" (or the like) means that a particular feature, structure, or characteristic described in connection with the embodiment is included in at least one embodiment. Thus, appearances of the phrases "according to embodiments" or "an embodiment" (or the like) in various places throughout this specification are not necessarily all referring to the same embodiment.

Furthermore, the described features, structures, or characteristics may be combined in any suitable manner in one or more embodiments. In the following description, numerous specific details are provided to give a thorough understanding of exemplary embodiments. One skilled in the relevant art will recognize, however, that aspects can be practiced without one or more of the specific details, or with other methods, components, materials, et cetera. In other instances, well-known structures, materials, or operations are not shown or described in detail to avoid obfuscation.

The materials used in Composition 4 (C-4) simulants manufacture vary greatly. Conventional formulations are intended to simulate some quality(s) of C-4. In the case of the modeling clay, the material is intended to only simulate the general appearance and weight of C-4. Formulations with inert crystalline surrogates replacing the energetic fraction do not exhibit the same plastic behavior, combustion behavior, or detection characteristics of C-4. Formulations containing the actual energetic dispersed over inert beads are intended to generate signatures for olfactory or electronic detection but none of the other characteristics of C-4. None of these or any other available compositions are designed to produce a formulation which simulates C-4 in all aspects including appearance, "feel', plasticity, combustion behavior, and detection characteristics.

Accordingly, embodiments provide a high fidelity, non-explosive training aid (simulant) which simulates the properties of the explosive C-4. The material of the training aid was formulated to simulate the appearance, manifest rheological properties (pliability, plasticity), density, and "feel" of the actual composition as well as simulate the combustion behavior of C-4 when subjected to the informal "flame test" used to identify the material in the field. Additionally, the material gives the same signature as actual C-4 when tested by portable detection equipment such as electronic trace detectors or color forming reagents. The material also generates the same imagery as C-4 when subjected to X-ray analysis.

The simulant can be used as a high fidelity, inert training aid, as for example used by Explosive Ordnance Disposal (EOD) and other organizations. The simulant can be used to simulate C-4 in different training scenarios using electronic detection and olfactory detection and is indistinguishable from the actual C-4 material. In an example formulation, the simulant material was composed of the following materials: ammonium nitrate, potassium nitrate, RDX, sucrose, hexamine, melamine, colloidal silica, polyisobutylene, mineral oil, dioctyladipate, dimethyldinitrobutane, and gelatin.

Simulant production includes preparing of a base mixture, inclusion of energetic component(s), inclusion of taggant(s), and inclusion of rheological agent(s). The simulant includes one or more rheological agents in an amount producing rheological properties of C-4. Additionally, the simulant includes one or more energetic, components as for example selected from ammonium nitrate, potassium nitrate, and RDX. The energetic components are included in an amount which, along with the other components of the simulant, permit simulant combustion (as per the flame test), but prohibit simulant explosion, making the simulant safe for use in training while mimicking combustion properties of C-4.

With reference to Table 1, an example procedure for a lab scale synthesis of ~50 grams of simulant material is as follows. In the following example formulation, it should be understood that although specific examples are given, suitable substitutions might be made for one or more of the reagents without departing from the scope of the invention. The weight percentages in Table 1 have been calculated as examples based on a total weight of 49.1 grams (of dry reagents) and the respective contribution of the example components polyisobutylene, dioctyladipate, gelatin, melamine, potassium nitrate, RDX, ammonium nitrate, hexamine, sucrose, dimethyldinitrobutane, and colloidal silica, rounded to the nearest 0.1%, as shown in Table 1. If appropriate substitutions are made, the percentages will change accordingly. Thus, the following procedure, reagents and amounts thereof are only given by way of example.

First, about 1.9 grams of a vinyl polymer (for example, polyisobutylene) was weighed and placed into a beaker. About 100 milliliters of hydrocarbon or non-polar solvent (for example, petroleum ether) was added to the beaker. The beaker was then tightly covered and let stand for 24 hours. Thereafter, the seal was replaced with a watch glass and the beaker was placed in a water bath and stirred with a magnetic stirrer at ~200 rpm for one hour.

The temperature of the bath was increased to 40-50 degrees centigrade and the stir rate was increased to ~300 rpm. Once temperature reached 40-50, the rpms were brought up and the next step occurred essentially immediately. Next, about 5.0 grams of plasticizer (for example, dioctyladipate), about 2.0 grams of liquid petroleum or hydrocarbon oil (for example, mineral oil), and about 0.1 grams of a gelling agent (for example, gelatin), which promotes proper rheological properties, were added to the solution and stirred for 10-15 minutes while maintaining the solution volume with aliquots of hydrocarbon or non-polar solvent (for example, petroleum ether). The temperature was reduced to 35-40 degrees centigrade, about 0.5 grams of a dispersing agent (for example, melamine) was added, and the solution was stirred for an additional 5 minutes.

Energetic components were added. For example, the following reagents were added in the following order: about 21.8 grams of an oxidizing agent (for example, potassium nitrate), about 3.5 grams of RDX, and about 2.5 grams of another oxidizing agent (for example, ammonium nitrate). In an exemplary embodiment, potassium nitrate, RDX, and ammonium nitrate include between about 50 percent weight of dry reagents and about 60 percent weight of dry reagents. Thereafter, about 2.6 grams of a stabilizing agent/fuel (for example, hexamine), about 9.1 grams of a hydrocarbon fuel (for example, sucrose), and about 0.5 grams of taggant/pseudoscent (dimethyldinitrobutane (DMDNB)) were added. This solution was stirred for ~30 minutes. Finally, about 1.6 grams of a thickening agent promoting proper rheological properties (for example, colloidal silica) was added and the solution was stirred for an additional 15 minutes.

After the colloidal silica was added and allowed to mix for ~15 minutes, the water bath temperature was reduced to promote increased viscosity. The temperature and stir rate were maintained to ensure incorporation, not to promote increased viscosity, and the watch glass was removed. The temperature was reduced to 30 degrees C. at this point. As the solvent evaporated and the viscosity increased, the material was stirred intermittently with a spatula. As the material acquired the consistency of a thick paste, the beaker was placed a vacuum desiccator, vacuum drawn and released several times. The beaker was returned to the water, still at 30 degrees C., until the material became semi-solid. The beaker was placed in a desiccator and allowed to set overnight. The dry material was removed from the desiccator and kneaded to the desired consistency.

TABLE 1

Example Simulant Formulation

| Reagent | Amount (weight %) | Order of Addition |
|---|---|---|
| Polyisobutylene | 1.9 g (3.9%) | 1 |
| Petroleum Ether | 100 ml (NA) | 2 |
| Dioctyladipate | 5 g (10.2%) | 3 |

TABLE 1-continued

Example Simulant Formulation

| Reagent | Amount (weight %) | Order of Addition |
|---|---|---|
| Mineral Oil | 2 g (NA) | 4 |
| Gelatin | 0.1 g (0.2%) | 5 |
| Petroleum Ether | As needed to maintain volume | 6 |
| Melamine | 0.5 g (1.0%) | 7 |
| Potassium Nitrate | 21.8 g (44.4%) | 8 |
| RDX | 3.5 g (7.1%) | 9 |
| Ammonium Nitrate | 2.5 g (5.1%) | 10 |
| Hexamine | 2.6 g (5.3%) | 11 |
| Sucrose | 9.1 g (18.5%) | 12 |
| Dimethyldinitrobutane | 0.5 g (1.0%) | 13 |
| Colloidal Silica | 1.6 g (3.3%) | 14 |

Referring to Table 2, the simulant formulation possesses the following features that make it quite similar to C-4. The formulation has the same color as C-4, that is, a white/off-white color. The formulation has the same texture as C-4, giving it a smooth touch and feel, having components incorporated. The formulation manifests rheological properties similar to C-4, having similar flexibility and elongation characteristics (strand formation) as C-4. The formulation's weight-to-volume ratio is similar to C-4, with a density of 1.56 gm/cc vs. 1.66 gm/cc for that of RDX. The formulation's detectability is similar to that of C-4, as an energetic (RDX) and a taggant (dimethyldinitrobutane) are present, making the formulation amenable to both trace and K-9 detection. The formulation exhibits a similar effective atomic number compared with C-4, allowing it to generate the same X-ray imagery as C-4. Finally, the formulation retains a fuel-like behavior, similar to C-4, with a TNT equivalency (calculated) of 0.39 (39%). This equivalency is similar to a hydrocarbon fuel, allowing the formulation to burn but not explode.

TABLE 2

Example Simulant Characteristics

| Characteristic | Simulant |
|---|---|
| Color | White/off-white |
| Texture | Smooth, components incorporated |
| Rheological Properties | Flexible, exhibits strand formation |
| Weight-to-Volume | 1.56 g/cc |
| Detectibility | Trace and K-9 Detection |
| Effective Atomic Number | Same X-ray imagery as C-4 |
| Fuel-like Behavior | TNT Equivalency of 0.39 (39%) |

The simulant, as described in the example formulation, represents the only material simulating the appearance, feel, plasticity and combustion behavior of C-4. Additionally, the simulant may be detected in the same fashion as C-4, for example by olfactory or electronic detection, and moreover generates the same imagery during x-ray analysis. Thus, the simulant may be used in any training scenario requiring a C-4 simulant.

This disclosure has been presented for purposes of illustration and description but is not intended to be exhaustive or limiting. Many modifications and variations will be apparent to those of ordinary skill in the art. The embodiments were chosen and described in order to explain principles and practical application, and to enable others of ordinary skill in the art to understand the disclosure for various embodiments with various modifications as are suited to the particular use contemplated.

In the specification there has been set forth exemplary embodiments of the invention and, although specific terms are used, the description thus given uses terminology in a generic and descriptive sense only and not for purposes of limitation.

Finally, any numerical parameters set forth in the specification and attached claims are approximations (for example, by using the term "about") that may vary depending upon the desired properties sought to be obtained by the embodiments of the present invention. At the very least, and not as an attempt to limit the application of the doctrine of equivalents to the scope of the claims, each numerical parameter should at least be construed in light of the number of significant digits and by applying ordinary rounding.

What is claimed is:

1. A composition 4 simulant, comprising:

a base mixture including at least one rheological agent in an amount effective for producing rheological properties of composition 4; wherein the base mixture further comprises a vinyl polymer, a plasticizer, liquid petroleum, a gelling agent, a dispersing agent, and a stabilizing agent; and at least one energetic components selected from the group consisting of ammonium nitrate, potassium nitrate, and RDX, wherein said at least one energetic component comprises an amount effective for permitting simulant combustion but prohibiting simulant explosion.

2. The composition 4 simulant of claim 1, further comprising at least one taggant in an effective amount for at least one of olfactory detection and electronic detection.

3. The composition 4 simulant of claim 1, wherein said at least one rheological agent comprises colloidal silica.

4. The composition 4 simulant according to claim 1, wherein said at least one rheological agent further comprises a non-polar solvent.

5. The composition 4 simulant of claim 1, wherein the vinyl polymer is polyisobutylene, wherein the non-polar solvent is petroleum ether, wherein the plasticizer is dioctyladipate, wherein the gelling agent is gelatin, wherein the dispersing agent is melamine, and wherein the stabilizing agent is hexamine.

6. The composition 4 simulant of claim 1, further comprising sucrose.

7. The composition 4 simulant of claim 1, wherein the simulant density is about 1.56 g/cc.

8. The composition 4 simulant of claim 1, wherein said at least one energetic component comprises an amount yielding a calculated TNT equivalency of about 40 percent.

9. The composition 4 simulant according to claim 1, wherein said at least one energetic component comprises an amount of between about 50 percent weight of dry reagents and about 60 percent weight of dry reagents.

10. A composition 4 simulant, comprising:

a mixture of non-energetic components including at least one of a dispersing agent, a stabilizing agent, a thickening agent, a vinyl polymer, a plasticizer, and a gelling agent; and a mixture of energetic components, including RDX, in an amount effective for permitting simulant combustion but prohibiting simulant explosion.

11. The composition 4 simulant of claim 10, further comprising at least one taggant in an effective amount for said at least one of olfactory detection and electronic detection.

12. The composition 4 simulant of claim 10, wherein the simulant includes a calculated TNT equivalency of about 40 percent.

13. The composition 4 simulant of claim 10, wherein the simulant includes a density equivalent to composition 4.

14. The composition 4 simulant of claim 10, wherein the simulant has an effective atomic number equivalent to composition 4.

15. A composition 4 simulant, comprising:

ammonium nitrate, potassium nitrate, RDX, sucrose, hexamine, melamine, colloidal silica, polyisobutylene, mineral oil, dioctyladipate, dimethyldinitrobutane, and gelatin.

16. The composition 4 simulant of claim 15, wherein ammonium nitrate comprises about 5.1 percent weight of dry reagents, wherein potassium nitrate comprises about 44.4 percent weight of dry reagents, wherein RDX comprises about 7.1 percent weight of dry reagents, wherein sucrose comprises about 18.5 percent weight of dry reagents, wherein hexamine comprises about 5.3 percent weight of dry reagents, wherein melamine comprises about 1.0 percent weight of dry reagents, wherein colloidal silica comprises about 3.3 percent weight of dry reagents, wherein polyisobutylene comprises about 3.9 percent weight of dry reagents, wherein dioctyladipate comprises about 10.2 percent weight of dry reagents, wherein dimethyldinitrobutane comprises about 1.0 percent weight of dry reagents, and wherein gelatin comprises about 0.2 percent weight of dry reagents.

17. The composition 4 simulant of claim 15, wherein said at least one energetic component comprises an amount yielding a calculated TNT equivalency of about 40 percent.

18. The composition 4 simulant of claim 15, wherein the simulant includes an effective atomic number equivalent to composition 4.

19. The composition 4 simulant of claim 15, wherein the simulant density is about 1.56 g/cc.

* * * * *